US006606942B2

(12) United States Patent
Steuer

(10) Patent No.: US 6,606,942 B2
(45) Date of Patent: Aug. 19, 2003

(54) DIE STAMPING METHOD AND DIE STAMPING DEVICE

(76) Inventor: Armin Steuer, Am Waldrand 30, D-71111 Waldenbuch (DE)

( * ) Notice: Subject to any disclaimer, the term of this patent is extended or adjusted under 35 U.S.C. 154(b) by 78 days.

(21) Appl. No.: 09/792,073

(22) Filed: Feb. 26, 2001

(65) Prior Publication Data

US 2002/0117060 A1 Aug. 29, 2002

(51) Int. Cl.[7] ..... B31F 1/07

(52) U.S. Cl. ..... 101/9; 101/11; 101/27; 101/32

(58) Field of Search ..... 101/8, 9, 10, 11, 101/21, 25, 27, 31, 32, 3.1

(56) References Cited

U.S. PATENT DOCUMENTS

| | | | | |
|---|---|---|---|---|
| 5,979,308 | A | * 11/1999 | Kagi et al. | 101/3.1 |
| 6,061,122 | A | * 5/2000 | Hoshino et al. | 356/71 |
| 6,142,069 | A | * 11/2000 | Eitel et al. | 101/25 |
| 6,164,355 | A | * 12/2000 | Boucherie | 156/358 |
| 6,405,779 | B1 | * 6/2002 | Wittkopf | 156/555 |
| 2002/0050714 | A1 | * 5/2002 | Imai et al. | 283/74 |

FOREIGN PATENT DOCUMENTS

| | | |
|---|---|---|
| DE | 37 13 666 | 10/1988 |
| DE | 37 18 048 | 12/1988 |
| DE | 90 04 865 | 9/1990 |
| DE | 43 09 799 | 9/1994 |
| DE | 197 09 963 | 9/1998 |
| GB | 2 036 649 | 7/1980 |

OTHER PUBLICATIONS

JP 6–198844 A., In: Patents Abstracts of Japan, M–1691, Oct. 21, 1994, vol. 18, No. 554.

* cited by examiner

*Primary Examiner*—Andrew H. Hirshfeld
*Assistant Examiner*—Ken D. Williams
(74) *Attorney, Agent, or Firm*—Nath & Associates PLLC; Gary M. Nath; Marvin C. Berkowitz

(57) ABSTRACT

The invention relates to a die stamping method and to a device for performing the method.

The problem of the invention is to reduce the production of waste during die stamping.

This is brought about in that on supplying the foil web to the stamping station a sensor means monitors whether there is a defect therein. If a defect is detected, the foil web supply to the stamping station is controlled in such a way that the defect is conveyed through the stamping station between two stamping operations. Thus, the defect does not arrive in the stamping or printing area of the stamping station, so that no waste is produced.

16 Claims, 3 Drawing Sheets

DIE STAMPING METHOD AND DIE STAMPING DEVICE

FIELD OF APPLICATION AND PRIOR ART

The invention relates to die stamping method and to a device for performing the method. DE 90 04 865 U1 e.g. discloses a hot stamping machine, in which to a stamping station is supplied a foil web, which has a transfer area comprising at least one layer to be transferred by die stamping.

It is admittedly known in connection with such hot stamping machines to orient the foil web with respect to its position, particularly the position of a motif periodically repeated on the transfer area, with respect to the stamping point in the stamping station in such a way that the motif is transferred in positionally precise manner to the stamping material.

However, when using such continuous foil webs it is possible for defects to occur in the foil web or in the transfer area. If such foil web or transfer area portions enter the stamping area, waste is produced, which must then be subsequently eliminated.

Problem and Solution

The problem of the invention is to reduce the production of waste in die stamping.

This problem is solved by the die stamping method and device according to the invention.

In die stamping in a stamping station a segment of a transfer area comprising at least one layer is stamped on a support or carrier material. The transfer area is supplied on a continuous foil web to the stamping station. On supplying the foil web to the stamping station it is established by a sensor means whether there are defects in the foil area of the foil web. If a defect is detected, the supply of the foil web to the stamping station is controlled in such a way that the defect is conveyed through the stamping station between two stamping operations. Therefore the defect does not pass into the printing area of the stamping station, so that no waste is produced. The procedure also has the advantage of the processing speed in the stamping station only being insignificantly influenced and the die stamping process can still be performed at high speed. This procedure is particularly advantageous if, as a result of manufacture, the foil material has defects at regular intervals. This is e.g. more particularly the case in transfer areas having holograms. The holograms can comprise individual images which are periodically repeated and diffraction gratings, optionally with patterns made therein, which are infinitely repeated on the foil. Such foils are frequently transferred to cartons and other papers, particularly packaging. This on the one hand takes place to prevent easy copying of the packaging and on the other frequently as a result of the optical and tactile effects which can be obtained.

However, foil webs stored on drums and which are used for the continuously supply of the foil web to the stamping station have attachment points, where a following foil web portion is attached to the foil web. Due to manufacture, these attachment points cannot be avoided.

According to an advantageous development of the invention the sensor means detects the electrical conductivity of the foil web.

According to further, advantageous developments of the invention, alternatively or additionally thereto, the sensor means can detect one or more optical characteristics of the foil web and it is in particular advantageous to determine the reflection behaviour thereof. According to another advantageous development the reflection behaviour is defined by a foil web-side diffraction grating. According to an advantageous development, for this purpose the sensor means has a laser light source, which directs light onto the foil web, the light intensity being detected in a diffraction maximum. It is concluded that there is a defect in the foil web, i.e. a disturbance of the diffraction grating, if the light intensity differs by a predetermined amount from the light intensity expected in this maximum.

According to a further advantageous development the sensor means comprises several sensors juxtaposed at right angles to the foil web conveying direction and it can be concluded that there is a defect in the foil web only if at least two sensors detect a signal corresponding to the existence of a defect in the foil web.

A die stamping device according to the invention is formed from a supply device for supplying foil web with the stamping foil to a stamping station of a control device for influencing the supply of the foil web to the stamping station and sensors for monitoring the foil web on the stamping station supply side. The foil web is supplied to the stamping station as a function of signals of the sensor means.

The stamping station is in particular a rotary stamping station formed from a stamping roller with a stamping die and a counter-roller. Only if the die is in engagement with the foil web is a segment of the transfer area transferred from the foil web to the carrier material. The carrier material can either be supplied sheetwise or as a continuous material web.

These and other features can be gathered from the claims, description and drawings and the individual features, either singly or in the form of subcombinations, can be implemented in an embodiment of the invention and in other fields and can represent advantageous, independently protectable constructions for which protection is hereby claimed. The subdivision of the application into individual sections and the subheadings in no way restrict the general validity of the statements made thereunder.

BRIEF DESCRIPTION OF THE DRAWINGS

An embodiment of the invention is described hereinafter relative to the drawings wherein show.

DESCRIPTION OF THE DRAWINGS

Figure 1:
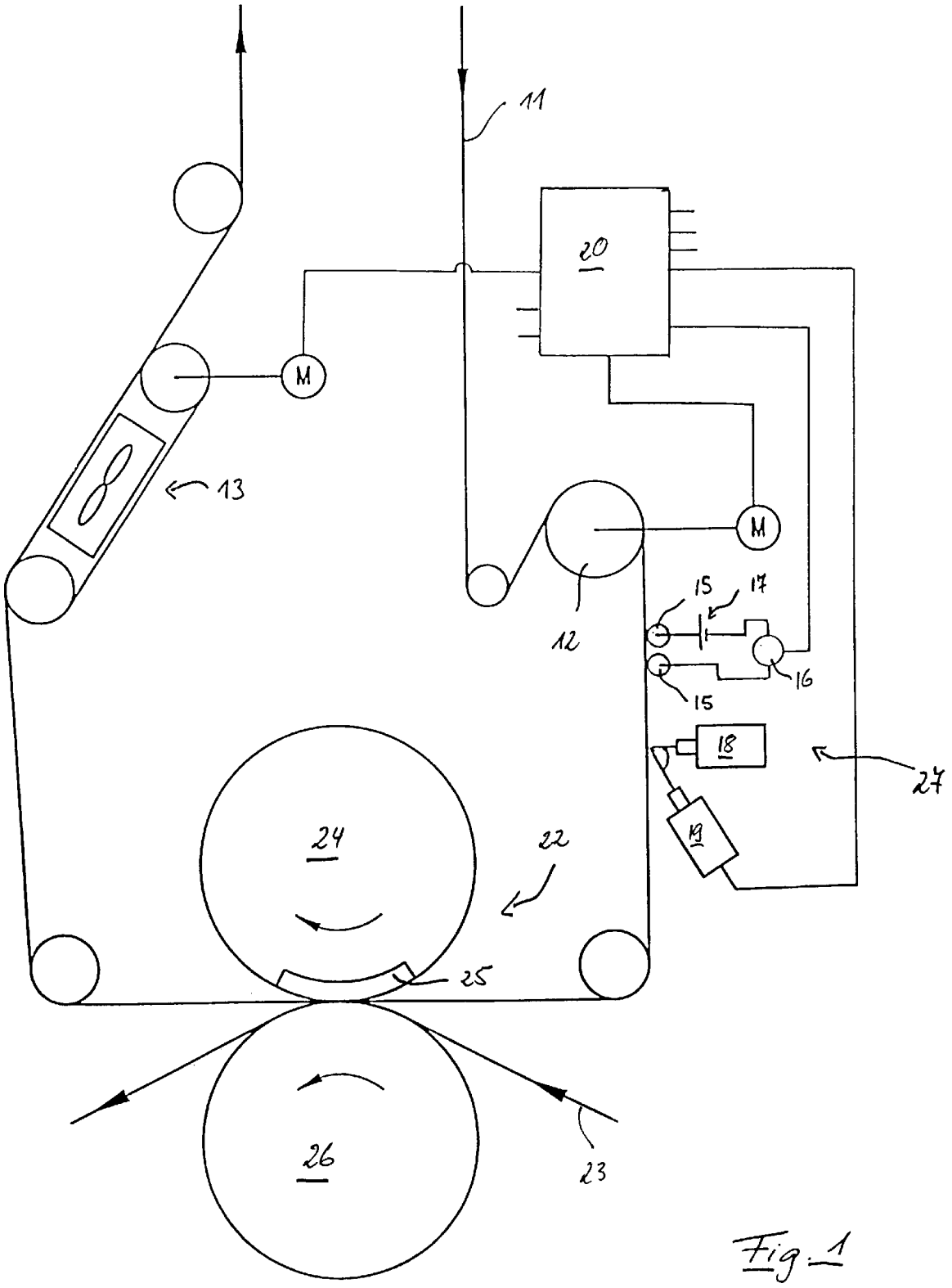
FIG. 1 A diagrammatic representation of a stamping station according to the invention.

FIG. 1 diagrammatically shows a die stamping device according to the invention for performing the die stamping method according to the invention.

During die stamping the foil web 11 and material web 23 are supplied to the die stamping device 22. In the examples shown the die stamping device 22 has a stamping roller 24 having a die 25, as well as a counter-roller 26. The die 25 of the die stamping device 22 can be preheated by means of a not shown heating element to a preset stamping temperature for hot stamping purposes. The contour of the die 25 projects over and beyond the outer contour of the stamping roller 24. During a stamping process, during which the die 25 is in engagement with the counter-roller 26, a transfer area segment is transferred from the foil web 11 to the material web 26. For this purpose the material web 23 and foil web 11 must move during the stamping process through the die stamping device 22 at the circumferential speed of the stamping roller 24.

To reduce to a minimum foil web consumption, the supply of foil web 11 can be so controlled or regulated that between two stamping operations the stamping foil 11 is moved back counter to the conveying direction of the material web 23 through the die stamping device 22 and is subsequently reaccelerated to the circumferential speed of the stamping roller 24, so that the printed transfer area segments are as closely juxtaposed as possible. Optionally during this process it is possible to respect a pitch, which is defined by position marks on the foil web. This is more particularly necessary if images are to be stamped, which are applied in periodically reoccurring manner on the foil web transfer area and consequently during stamping it is necessary to maintain a precise positional relationship between foil web 11 and material web 23. For performing this control or regulation the foil web 11 is accelerated and decelerated conveyed forwards and backwards by means of the driving pulley 12 and suction belt 13 and the operation is controlled by the control device 20.

A sensor means 27 is located between the driving pulley 12 and stamping device 22. The sensor means 27 is formed by sensors for detecting the electrical conductivity of the foil web and sensors for detecting the light diffraction through the foil web.

The electrical conductivity is measured by means of two contact rolls 15 successively positioned in the conveying direction of the foil web 11 and extending substantially over the entire width of the transfer area or the foil web. A power supply 17 is positioned between the contact rolls 15, which are constructed as electrically conductive rolls. The ammeter 16 detects the current passing through the circuit with the contact rolls 15 and transmits a corresponding signal to the control device 20. The circuit between the two contact rolls 15 is closed by means of the foil web 11. If there has been damage to the surface of the foil web or the latter has been interrupted and attached by means of a splice 28, there is a change to the electrical conductivity of the foil web in the area between the two contact rolls 15. The transfer area of the foil web having a diffraction pattern, particularly a diffraction grating at right angles to the foil web conveying direction, is illuminated with light of a known wavelength by means of laser 18. By means of the photoelectric cell 19, which is located in the ray direction of the nth order diffraction maximum, the reflection behaviour of the transfer area is determined. An intensity reduction of the signal at the photoelectric cell 19 is evaluated as being caused by a defect in the foil web transfer area by the control device 20, which is supplied with a signal representing the measured intensity of the photoelectric cell 19.

As the spacing of the measurement points from the die stamping device 22 is fixed and is a known value, the position of the defect on the foil web 11 with respect to the stamping point where a segment of the transfer area is stamped on the carrier web 23 is known. The control device 20 now controls or regulates the advance of the foil web in such a way that the die 25 does not come into engagement with a foil web portion having a defect. Thus, the defects are not transferred to the carrier web 23. Thus, there is no waste resulting from foil web defects.

Figure 2:
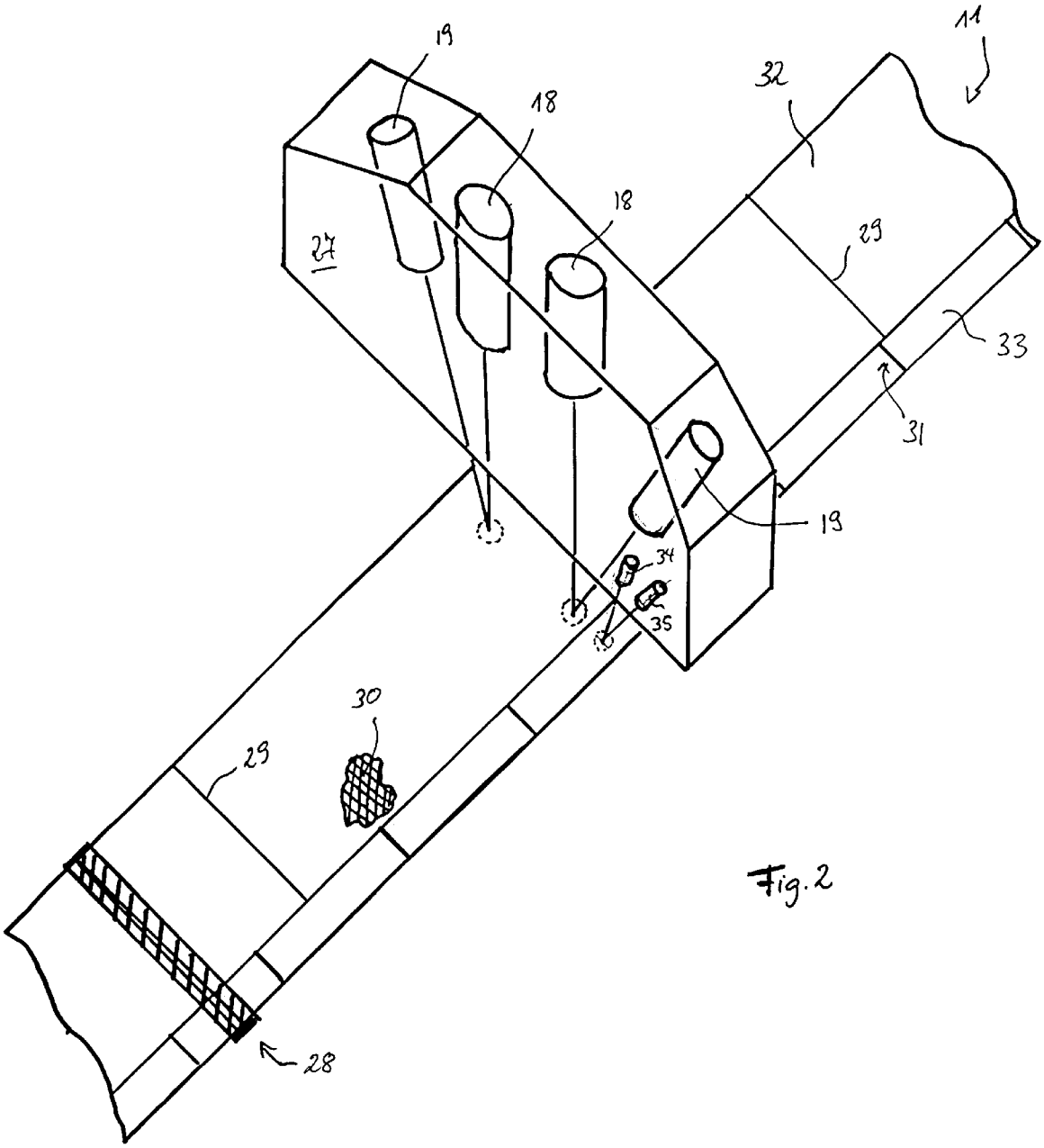
FIG. 2 An embodiment with respect to the optical detection of defects in a holographic foil.
Figure 3:
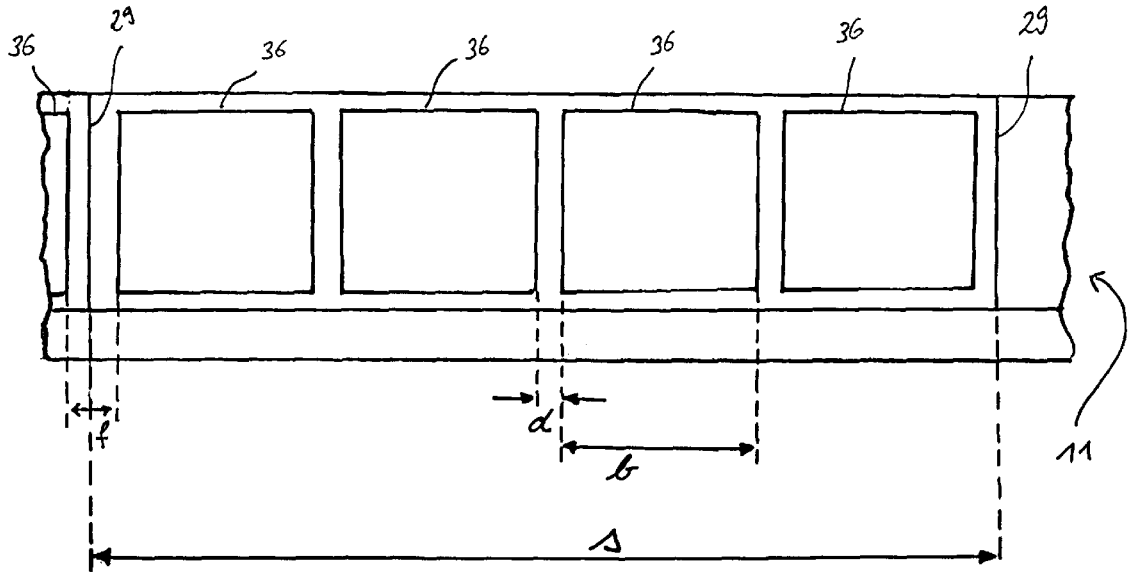
FIG. 3 The diagrammatic representation of a holographic foil.

FIG. 2 shows a foil web 11 moved under the sensor means 27. The foil web 11 comprises the transfer area 32 and layer web 33. The layer web 33 has raster marks 31, which define the position of a motif applied in repeated manner on the transfer area 32. If the foil has no repeating motif, it is not necessary for the foil web 11 to have the layer web 33 in addition to the transfer area 32. The sensor means 27 is formed from two pairs of lasers 18 and photoelectric cells 19. Each of the two lasers 18 emits a light beam to the transfer area 32. The two light spots are located on the foil web at right angles to the foil conveying direction with respect to the sensor means 27. The photoelectric cells 19 are positioned with respect to the lasers 18 and transfer area 32 in the radiation direction of the nth order maximum of the holographic diffraction pattern having the transfer area 32. For detecting the position of the raster marks 31 on the layer web 33 the sensor means is additionally provided with a light source 34 and a photoelectric cell 35, which are merely used for determining the raster mark positions.

The transfer area 32 can have different faults or defects FIG. 2 shows as faults the grease spot 30, splice 28 and shim edges 29. The shim edges 29 arise during the manufacture of the transfer areas having holographic images, particularly a holographic diffraction grating. The shim edges 19 are regularly spaced on the transfer area. If a defect is now moved under the sensor means 27, the light diffraction of the light beam emitted by the lasers 18 is disturbed. In the case of a grease spot 30 only the signal to one of the two photoelectric cells 19 is disturbed. However, the presence of a grease spot or similar dirt phenomenon does not necessarily prejudice the suitability of the transfer area segment for transferring to the carrier web. Thus, this transfer area segment need not necessarily be looked upon as waste and consequently cannot be excluded from transfer to the material web. However, both a shim edge 29 and splice 28 interrupt the diffraction in the transfer area to both photoelectric cells 19. A shim edge is a portion of the transfer area 32 which must not be used for stamping purposes and must consequently not come into engagement with the die 25 of the stamping roller 24 during a stamping process. As shim edges are only very narrow, on the basis of the light diffraction interruption time in the transfer area 32 a distinction can be made between a shim edge 29 and a splice 28, which also constitutes waste, by establishing the time during which the fault or defect lasts. A long light diffraction interruption in the transfer area 32 points to a splice 28. If the foil web 11 also has a layer web 33, it is also possible to detect a splice 28 in that additionally the reflection signal of the light source 33 in the photoelectric cell 35 in the vicinity of the splice distinguishably differs from the raster marks 31.

FIG. 1 shows a foil web 11 having shim edges 29 with a spacing s. Through the size of the die 25 of the stamping roller 24 the length b is known, which has a transfer area segment transferred by stamping by die 25 to material web 23. As the spacing s between two shim edges 29 is known, the spacing d between two segments 36 can be determined in such a way that the maximum number of segments 36 can be housed between the two shim edges and simultaneously the segments 36 are uniformly spaced from one another with the spacing d. The spacing f between two segments including a shim edge will generally have a value greater than the spacing d between two segments 36. It must be borne in mind that the spacing b is a minimum value resulting from the adjustment precision of the foil web in the stamping device 22 as well as tolerances and material changes during the hot stamping process and there must be no drop below this value. This permits an optimum transfer area utilization, whilst simultaneously having a uniform foil web conveying speed. This is naturally only the case if the transfer area 32 has a continuous pattern and no image which has to be positionally adjusted with respect to the die 25 of the stamping roller 24. If there is a shim edge 29 in the image area in the case of an image-possessing foil, it is necessary to eliminate as waste the entire transfer area portion containing said image.

What is claimed is:

1. Die stamping method, in which a segment of a transfer area is stamped in a stamping station on a carrier material, the transfer area being supplied in the form of a continuous foil web to the stamping station, characterized in that:

on supplying the foil web to the stamping station, by means of a sensor means, defects in the foil web are detected and said defect are conveyed through the stamping station between two stamping operations;

the sensor means having several sensors, which are displaced at right angles to the conveying direction of the foil web whereby it can be concluded that a defect is present if on at least two sensors simultaneously a signal occurs corresponding to the presence of the defect.

2. Die stamping method according to claim 1, characterized in that the sensor means detects optical characteristics of the transfer area.

3. Die stamping method according to claim 2, characterized in that the sensor means (27) detects the reflection behaviour of the transfer area (32).

4. Die stamping method according to claim 3, characterized in that the transfer area (32) has a diffraction grating and the sensor means (27) detects light diffraction interference on the diffraction grating.

5. Die stamping method according to claim 4, characterized in that the sensor means (27) comprises laser light source (18) and a photometer (19) located in a diffraction maximum.

6. Die stamping method, in which a segment of a transfer area is stamped in a stamping station on a carrier material, the transfer area being supplied in the form of a continuous foil web to the stamping station, characterized in that:

on supplying the foil web to the stamping station, by means of a sensor means, defects in the foil web are detected and said defect are conveyed through the stamping station between two stamping operations; and the sensor means detects the electrical conductivity of the foil web.

7. Die stamping method, in which a segment of a transfer area is stamped in a stamping station on a carrier material, the transfer area being supplied in the form of a continuous foil web to the stamping station, characterized in that:

on supplying the foil web to the stamping station, by means of a sensor means, defects in foil web are defected and said defects are conveyed through the stamping station between two stamping operations;

at regular intervals (d) a segment of the transfer area having a predetermined length is stamped on the carrier material; and the transfer area has at regular intervals (s) defects, the maximum number of segments of predetermined length between two defects is determined and the supply of the foil web to the stamping station is carried out in such a way that the maximum number of segments between two defects on the foil web are uniformly mutually spaced.

8. Die stamping method according to claim 7, characterized in that the sensor means detects optical characteristics of the transfer area.

9. Die stamping method according to claim 8, characterized in that the sensor means detects the reflection behaviour of the transfer area.

10. Die stamping method according to claim 9, characterized in that the transfer area has a diffraction and the sensor means detects light diffraction interference diffraction grating.

11. Die stamping method according to claim 10, characterized in that the sensor means comprises laser light source and a photometer located in a diffraction maximum.

12. Die stamping device with a supply device for supplying at least one foil web with a transfer area, having a control device for the conveying of the at least one foil web through the supply device, with a stamping station in which a transfer area segment is stamped on a carrier material, characterized in that:

a sensor means, for monitoring the at least one foil web, comprising several sensors displaced at right angles to the foil web conveying direction, the sensors being located on the supply side of the stamping station, the sensor means for concluding that a defect is present if on at least two sensors simultaneously a signal occurs corresponding to the presence of the defect; and whereby the supply of the at least one foil web to the stamping station takes place by the control device as a function of the sensor means, such that said defects identified by said simultaneous signal from said at least two sensors are conveyed through the stamping station between two stamping operation.

13. Die stamping device according to claim 12, characterized in that the stamping station (22) comprises a stamping roller (24), having a die (25), and a counter-roller (26).

14. Die stamping device according to claim 12, characterized in that the carrier material (23) is supplied as a continuous material web.

15. Die stamping device according to claim 12, characterized in that the carrier material (23) is supplied sheetwise to the stamping station and on each sheet is stamped at least one segment (36) of the transfer area (32).

16. Die stamping device according to claim 1, characterized in that the die stamping device is a hot stamping machine.

* * * * *

UNITED STATES PATENT AND TRADEMARK OFFICE

CERTIFICATE OF CORRECTION

PATENT NO. : 6,606,942 B2
DATED : August 19, 2003
INVENTOR(S) : Armin Steuer

It is certified that error appears in the above-identified patent and that said Letters Patent is hereby corrected as shown below:

Column 5,
Lines 11 and 39, change “defect” to -- defects --
Line 48, after “in” insert -- the --

Column 6,
Line 15, after “diffraction” insert -- grating --
Line 16, after “interference” insert -- on the --
Line 49, change “Claim 1” to -- Claim 12 --

Signed and Sealed this

Twenty-fifth Day of November, 2003

JAMES E. ROGAN
*Director of the United States Patent and Trademark Office*